US006286266B1

(12) United States Patent
Popowych et al.

(10) Patent No.: US 6,286,266 B1
(45) Date of Patent: Sep. 11, 2001

(54) TREE STYLED MONOPOLE TOWER

(76) Inventors: Nestor T. Popowych, 231 Belle Plaine St., Park Ridge, IL (US) 60068; Roy J. Moore, 3508 Orchid Ct., Arlington, TX (US) 76016; Harold H. Sriver, III, 2713 Hartzell St., Evanston, IL (US) 60201; Louis Ken-Hon Kao, 1925 Deforest La., Hanover Park, IL (US) 60103

( * ) Notice: Subject to any disclaimer, the term of this patent is extended or adjusted under 35 U.S.C. 154(b) by 0 days.

This patent is subject to a terminal disclaimer.

(21) Appl. No.: 08/202,444

(22) Filed: Feb. 28, 1994

(51) Int. Cl.[7] ..... E04H 12/08
(52) U.S. Cl. ..... 52/40; 52/721.2; 52/736.2
(58) Field of Search ..... 52/40, 727, 726.4, 52/721, 736.1, 736.2, 736.3, 738.1, 651.01, 651.02, 651.07; 428/7, 10, 8, 20, 9, 18, 19

(56) References Cited

U.S. PATENT DOCUMENTS

| | | | | |
|---|---|---|---|---|
| D. 244,570 | | 6/1977 | Taylor | 98/29 |
| D. 309,208 | | 7/1990 | Cajigas | D34/1 |
| 1,656,310 | | 1/1928 | Anderson . | |
| 2,166,002 | | 7/1939 | Fritsch | 41/24 |
| 2,218,740 | | 10/1940 | Burke | 41/24 |
| 2,251,705 | | 8/1941 | Gonzalez | 62/1 |
| 2,303,569 | | 12/1942 | Menard | 41/34 |
| 3,144,375 | | 8/1964 | Day | 161/24 |
| 3,170,587 | | 2/1965 | Beeber | 220/18 |
| 3,317,365 | | 5/1967 | Reichert et al. | 161/22 |
| 3,562,403 | | 2/1971 | Monahan et al. | 52/169 |
| 3,571,991 | * | 3/1971 | Doocy et al. | 52/651.02 X |
| 3,829,349 | * | 8/1974 | Hermanson | 428/8 |
| 3,857,747 | | 12/1974 | Bitecola | 161/19 |
| 3,887,415 | | 6/1975 | Elmendorf et al. | 156/154 |
| 3,928,712 | | 12/1975 | Sears | 161/22 |
| 4,007,075 | | 2/1977 | McClain | 156/189 |
| 4,343,842 | * | 8/1982 | Chase | 428/8 |
| 4,359,737 | | 11/1982 | Bond | 343/18 |
| 4,468,421 | * | 8/1984 | Wang | 428/8 |
| 4,769,967 | | 9/1988 | Bourrieres | 52/727 |
| 4,855,167 | | 8/1989 | Biehl | 428/18 |
| 5,085,900 | | 2/1992 | Hamlet | 428/18 |
| 5,091,227 | | 2/1992 | Wright et al. | 428/18 |
| 5,104,467 | | 4/1992 | Johnson | 156/61 |
| 5,106,042 | | 4/1992 | Sloane | 248/121 |
| 5,130,496 | | 7/1992 | Jenkins | 174/135 |
| 5,150,874 | * | 9/1992 | Spiegel | 428/8 X |
| 5,611,176 | | 3/1997 | Juengert et al. . | |

OTHER PUBLICATIONS

Sautter, William H., "Clones, Poles Apart", The New York Times Magazine, Sunday edition, Aug. 27, 1995, p. 22.

* cited by examiner

*Primary Examiner*—Beth A. Stephan

(57) ABSTRACT

A modified monopole tower is described, consisting primarily of a galvanized steel truncated pyramidal monopole capped by cellular phone apparatus. In the preferred embodiment, the monopole head is ringed by three coronae of steel female receptors which are welded to the pyramidal head of the tower. Artificial palm fronds are attached to the receptors primarily by mechanical means. The modified monopole tower is designed to function optimally under all weather conditions, while beautifying the landscape with attachment of indigenous tree components.

3 Claims, 5 Drawing Sheets

1
32
27
28
29
5
26
22
13
21
48
14
33
10
11
20
17
15
16
8
2
6
7
4
3
9
12

48
40
33
5
39
33
38
10
48
8
2
7
40

TREE STYLED MONOPOLE TOWER

BACKGROUND OF THE INVENTION

The present invention relates to a metal cellular telephone equipment support structure, and artificial palm tree components which function as a camouflage and disguise. More particularly, the present invention relates to a cellular phone equipment tower which contains cellular phone transmitting and receiving apparatus, and artificial fronds attached to a vertical pole to comprise a tower in the guise of a tree.

There has been a long-standing need in the telecommunications industry for an aesthetically pleasing motif, such as a shrub or tree, that would disguise the otherwise stark pole-type structure currently available. Moreover the tower must be functional and support all the functional elements of a cellular telephone communication system. The camouflage elements must also be strong and resilient, and not become safety hazards in strong winds.

In the past others have suggested numerous treatments and structures for constructing artificial plants for purely decorative purposes or functionally to cover utility poles and the like. For example, one choice might be to simply construct a completely rigid structure with a widened crown which would contain artificial foliage at either end of a pole-like structure. However, others have recognized the potential weather problems with this choice. For example, U.S. Pat. No. 4,359,737 (Bond) discloses an artificial tree for absorbing and scattering radiation. Attenuating means on the leaves are electrically conductive particles forming dipoles to accomplish coherent absorption and scattering of radiation. However, this device is not constructed to withstand high winds and temperature extremes as is contemplated in the present invention.

U.S. Pat. No. 5,085,900 (Hamlett) discloses an artificial palm tree apparatus comprising a trunk, a cylindrically shaped cap, a plurality of fronds, and a support tube. This artificial palm tree has a cylindrical pole which simulates a trunk when covered with artificial palm tree bark. The structure is made up of sections with couplings for connecting the sections during installation. Although disguised like the instant invention because it simulates and reassembles a palm tree, the structure of Hamlett's invention is not an integral part of a galvanized steel tapering pyramidal monopole with attachments for artificial fronds at the top of the monopole.

In contrast, in the present invention the electronic receiving and transmitting devices are an integral component. In other words, Hamlett's end product is the tree, whereas in the present invention the housing of the cellular telephone apparatus is the end product which is camouflaged to blend in with the other trees in the area. There is also no discussion in Hamlett's patent of the use of an artificial palm tree to house cellular telephone equipment and the like.

U.S. Pat. No. 4,855,167 (Biehl) discloses artificial trees which are intended to shade an outdoor parking area. These artificial trees contain branches attached to three axially spaced distinct tiers of apertures located on the top end of the trunk for providing shade. U.S. Pat. No. 3,928,712 (Sears) discloses a terminal enclosure with artificial foliage. This structure is comprised of a post terminal covered by an upright cone-like housing having a wire support frame secured externally thereto and supporting simulated foliage. This structure is designed specifically to camouflage and protect ground terminals for utility companies.

U.S. Pat. No. 3,144,375 (Day) discloses an artificial tree which may be used for outdoor or indoor aesthetic purposes.

Instead of synthetic resins for leaves, green lacquers are applied. The artificial trunk has male and female joints so that a tree ranging from small to large may be assembled. U.S. Pat. No. 3,562,403 (Monahan et al.) discloses resin coated wooden poles and light standards, for stress relief and ventilation purposes. U.S. Pat. No. 5,130,496 (Jenkins) discloses an aesthetic electrical cord cover which consists of an elongated tubular body having simulated leaves protruding outwardly from the outer surface of the body.

U.S. Pat. No. 5,104,467 (Johnson) discloses a method for constructing artificial plants having a natural appearance. However, this method only provides for modifying artificial foliage for a more airy, naturally appearing leaf pattern, and which is ultimately combined with naturally occurring plants. Clearly, then, the function of this invention is not to provide protection from adverse weather conditions and beautification of electronic apparatus.

U.S. Pat. No. 5,091,221 (Wright et al.) discloses a decorative tree which is easily assembled and particularly adapted to blend with the furniture of the room in which it is placed. Again, this invention is not designed to house electronic equipment and antennaee in an exterior environment. U.S. Pat. No. 3,857,747 (Bitecola) describes an artificial shrub with a high density polyethylene shell to which foliage sprays are stapled in multitiered fashion. The primary purpose of this artificial shrub is to protect the open mouth of a pot which has been placed on the ground. U.S. Pat. No. 3,887,415 (Elmendorf et al). describes a panel with a decorative bark surface, and describes the method of making the bark. U.S. Pat. No. 2,303,569 (Menard) describes a similar artificial bark and method for its construction.

U.S. Pat. No. 2,251,705 (Gonzalez) describes an artificial palm tree "for interior decoration and human comfort." Specifically, the artificial palm is constructed so that the interior can contain a limited air conditioning system. U.S. Pat. No. 2,218,740 (Burke) describes another process of producing imitation tree bark, as does U.S. Pat. No. 2,166,002 (Fritsch).

U.S. Pat. No. 4,769,967 (Bourrieres) describes a pole of plastic material for supporting electric power transmission lines, and U.S. Pat. No. 4,007,075 (McClain et al.) describes a method for making a fiberglass pole. U.S. Pat. No. 3,317,365 (Reichert et al.) describes a nonflammable synthetic decorative tree branch.

U.S. Pat. No. 3,170,587 (Beeber) describes devices for concealing and supporting refuse receptacles on the exterior of a residence, which, however, simulate shrubbery and other plants which would naturally be found on a lawn or in a back yard. Anderson's artificial tree, U.S. Pat. No. 1,656,310, comprises a base with a trunk extending upwardly from the base, and the trunk being formed so that it can receive a plurality of natural tree branches.

Sloane, U.S. Pat. No. 5,106,042, describes a display pole assembly for merchandising displays. The decorating object may be a tree which is mounted on top of a pole section, and the pole may be covered with bark to simulate a tree trunk. Cajigas, U.S. Pat. Des. 309,208 discloses a trash container with a leaf-lid container top. Taylor's design patent (Des.244,570), discloses a combined merchandise display counter and ceiling air circulator, which is designed to have some attributes of a palm tree.

None of foregoing structures have environmentally resilient, galvanized steel monopoles supporting a large weight of cellular phone apparatus and radio receivers. They also do not have artificial foliage components which camouflage without interfering with emanating radio signals. The present invention is more aesthetically pleasing in that it will retain its plant-like characteristics outdoors for many years.

SUMMARY OF THE INVENTION

To solve this problem in the industry, the present invention provides a cellular telephone antennae tower of monopole construction which houses and supports electronic cellular antennae and camouflages them as well. In addition, because it is intended for outdoor use, the present invention is engineered so that the artificial palm fronds with artificial stems will not break and fall from the tower.

Accordingly, an object of the present invention is to provide a cellular telephone antennae tower which provides an appropriate functional height for the intended service.

Another object of the present invention is to provide artificial palm tree components that camouflage the cellular phone components.

Another object of the present invention is to provide a strong, yet lightweight artificial greenery which blends with the indigenous flora to disguise a cellular antennae monopole tower.

Another object of the present invention is to provide artificial tree components which can withstand adverse weather conditions while attached to the monopole and yet maintain an aesthetic appearance for many years. Another object of the present invention is to provide artificial fronds of a palm tree so that an antennaee can be placed securely among the fronds, yet not have the cellular phone antennae patterns disrupted thereby.

Yet another object of the invention is to provide the artificial tree components which will camouflage the electronic and cellular components without interfering with the transmission or reception of specific radio signals.

These and still other objects and advantages of the present invention will become apparent from the following description of the preferred embodiment.

BRIEF DESCRIPTION OF THE DRAWINGS

The present invention may be better understood by reference to the drawings accompanying this specification.

DETAILED DESCRIPTION OF THE INVENTION

Figure 1:
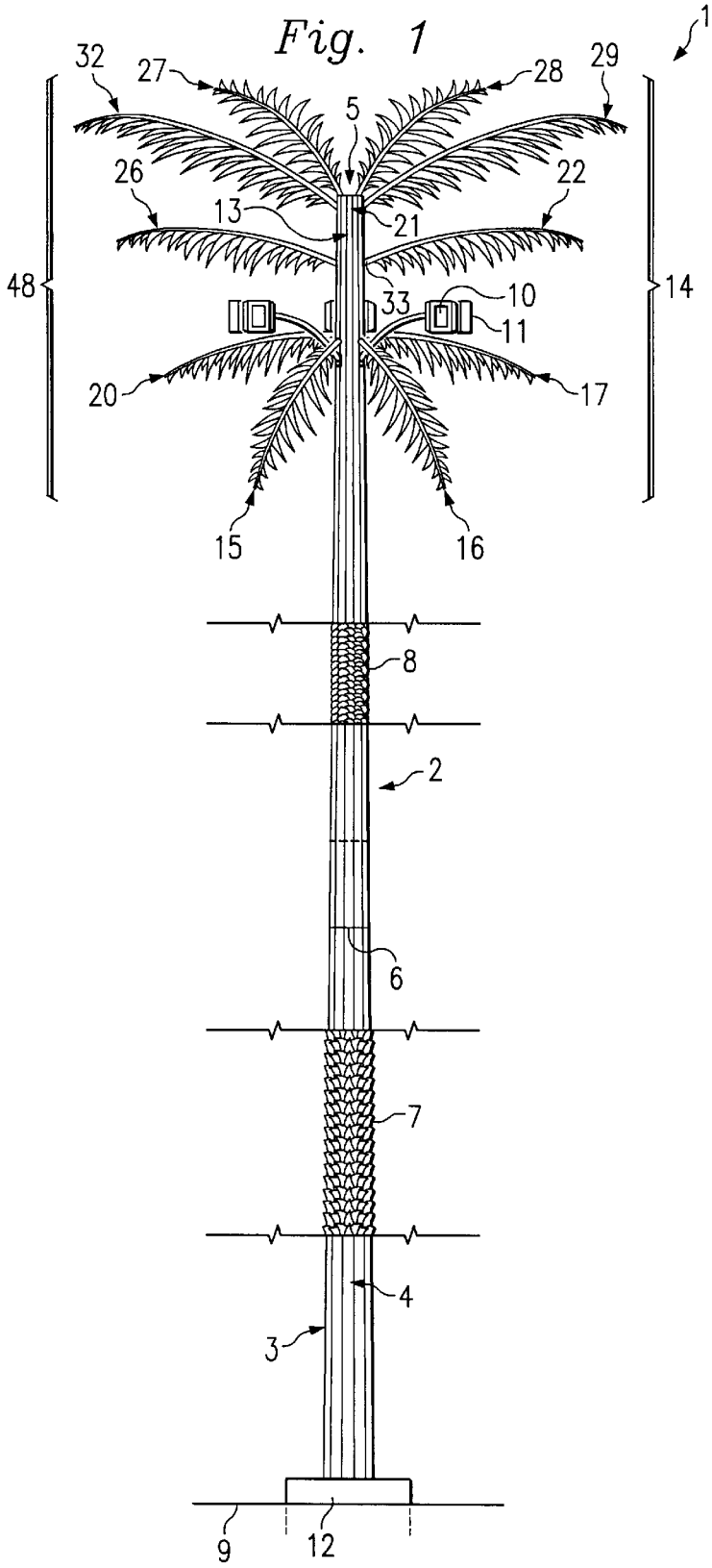
FIG. 1 is an illustration of the entire monopole tower with protruding artificial palm fronds and antennae.

The present invention, best described as a monopole cellular telephone antennae tower 1 with natural ornamentation, in the preferred embodiment is primarily a cellular telephone tower, including antennae 10, receivers, a galvanized steel tapering pyramidal monopole 2, and artificial palm tree components. Specifically, the invention is comprised of a metal monopole 2 which tapers upward and terminates to a tip or a cap plate 5, to support the cellular apparatus and antennae panels 10 of the structure. The monopole itself 2, without artificial appurtenances or components, typically has 8, 12, or 16 sides, seen at 3,4, on the monopole 2. The number of sides or facets will depend upon the tower's height, the wind load for a particular cellular antennae configuration, and the accompanying artificial palm frond camouflage. At the upper end of the monopole 2 there are artificial palm fronds 48 attached by mechanical means to outwardly protruding metal female receptors 33, which will be described in detail below. The monopole 2 is of the type provided by FWT, Inc., of FWT.

In the preferred embodiment, the electronic structure is comprised of a galvanized steel monopole 2 which tapers upwardly from the ground to a tip or cap plate 5 at the very top of the monopole. As already mentioned, this steel monopole 2 can be many sided or faceted, depending upon the required height and an engineer's calculations for wind resistance and velocity. The shaft steel for construction of monopole 2 is ASTMA 572 Grade 65,50, or 36, and the galvanizing process is ASTM-A123. The antennae cable entries are at the base 12, as is the tower foundation. There is also a butt connection 6 for different types of simulated palm bark components along the length of the monopole 2. In the preferred embodiment, at the upper end of the monopole 2 are six directional panel antennae 10 cantilevered on arms 15 of steel tubing. However, the invention also contemplates that the steel arms for antennae 10 can emerge from between any level of palm fronds 48.

In the preferred embodiment, the artificial plant components simulate a palm tree. Also in the preferred embodiment, the artificial palm fronds 48 are approximately eight feet long and thirty-six (36) inches wide at the base, while tapering to ten inches wide at the tip of the frond. However, the invention also contemplates a range in frond length of between approximately four feet to approximately ten feet. The stem of the frond is approximately 1 and ½ inch in diameter at its base and tapers to approximately ⅜ inch at its tip. The leaflets which comprise the fronds are molded of polyurethane with a greenish coloring. Each artificial stem of a frond is embedded with a steel rod which extends from the base towards the tip of the frond. Injection of adequate polyurethane at the junctions between each leaflet and the stem 38 of the frond insures stability during strong wind conditions. Each frond 48 ranges in weight from 3025 grams (6 lbs. 11 oz.) to 3652 grams (8 lbs. and 1 oz). One source of the palm fronds 48 and attached leaflet material is Preserved Treescapes International of Carlsbad, Calif.

FIG. 1 illustrates a side view of the entire monopole cellular apparatus structure 1. In the preferred embodiment, the plurality of sides, or facets on the galvanized steel monopole 2 can be seen at 3 and 4. This multifaceted galvanized steel monopole 2 rises upwardly as a tapering truncated pyramidal form to either simply terminate at its tip at the top of the monopole 2, or terminate in a cap plate 5. The degree of taper for the monopole 2 is 0.25 to 0.5 inch per foot.

Also in the preferred embodiment, the steel monopole 2 is clad with two kinds of simulated bark. Intended for the lower portion of the monopole is fiberglass 7, cast as tubes within a mold to simulate natural palm bark, and which is fairly rigid. The matrix for the fiberglass material may be acrylic, silicone, or epoxy. The upper portion, generally fifteen feet above the base of the monopole 2, is covered with a polyurethane, and is also cast to simulate natural tree bark 8. The polyurethane allows the upper covering more flexibility when the monopole 2 sways during adverse weather conditions. The two kinds of bark castings 7,8 are first cut to naturally fit around the bottom or upper portion of the monopole 2. The two kinds of bark, upper and lower, then meet at a butt junction 6 approximately 15 feet from the base of the monopole 2. However, the use of only one kind of artificial or simulated palm tree bark to cover the entire monopole 2 is also contemplated within the scope of this invention.

In the preferred embodiment, the monopole tip or cap plate 5 is elevated approximately 30 to 70 feet from the ground 9. However the monopole can be as high as 125 feet, and is made of shaft steel ASTMA 572 grades 65, 50, or 36. In addition, in the preferred embodiment, immediately below the monopole tip or cap plate 5 are the directional panels 10, with a total of six antennae panels 11. However, as already noted, the supports for the antennae can emerge between any level of fronds 48. The galvanized steel monopole 2 is approximately thirty inches in diameter at its base 12 and tapers to 16 inches in diameter towards its upper portion 13. The baseplate number is of material ASTMA 572 Grade 50 steel. During wind tunnel tests conducted on the artificial fronds, such fronds adhered to their attachments at wind speeds up to 110 miles per hour for at least 10 to 12 minutes.

FIG. 1 illustrates a side view of the structures which comprise the three parallel steel coronae 14 with artificial fronds 48. In this context the term corona signifies a ring around the upper part of a structure. In the present invention, these coronae each contain six artificial palm fronds 48, which emerge at the top portion of the monopole 2 or the monopole tip or cap plate 5. The lowest corona 14 along the monopole is located at fronds 15,16,17,18, although 19,20 cannot be seen from this view. The next higher corona 14 is at 21,22,23,24,25,26 and the highest corona 14 is at 27,28, 29,30,31,32. Again, fronds 24,25,26 in the middle corona and 31,32 in the highest corona cannot be seen in this figure. Each of the two highest corona 14 typically has six female upwardly protruding receptors 33 for a total of twelve receptors 33. However, the bottom corona 14 has six female receptors protruding slightly downward, so that when fronds 48 are attached, they have a natural, drooping appearance. To further enhance this natural appearance, the fronds 48 from the lowest corona a re shorter than the upper fronds and are different shades of green, yellow, and brown. The designed windload for the fronds 48 and other apparatus attached to the tower 2 is up to 110 miles per hour for ten to twelve minutes.

Figure 2:
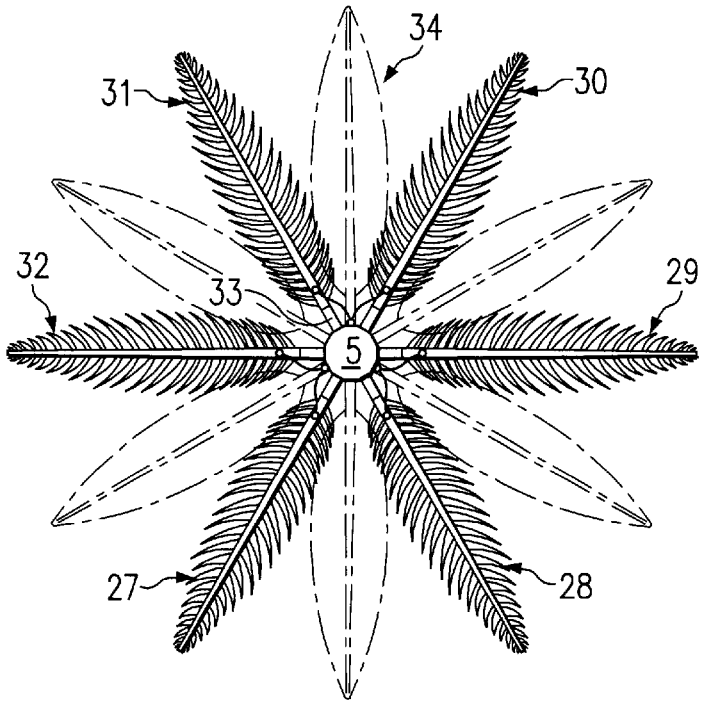
FIG. 2 is a plan view of the uppermost outwardly protruding metal female receptors with artificial fronds in coronae.

FIG. 2 illustrates a plan view of the highest corona 34, where each female receptor 33 is approximately 8 inches in length. Typically, the female receptors 33 are approximately 60 degrees in either direction from each adjacent female receptor. However, the arrangement in corona 34 can be in a range of ten to 110 degrees apart to accommodate antennae and to make the arrangement of fronds appear more natural.

Figure 3:
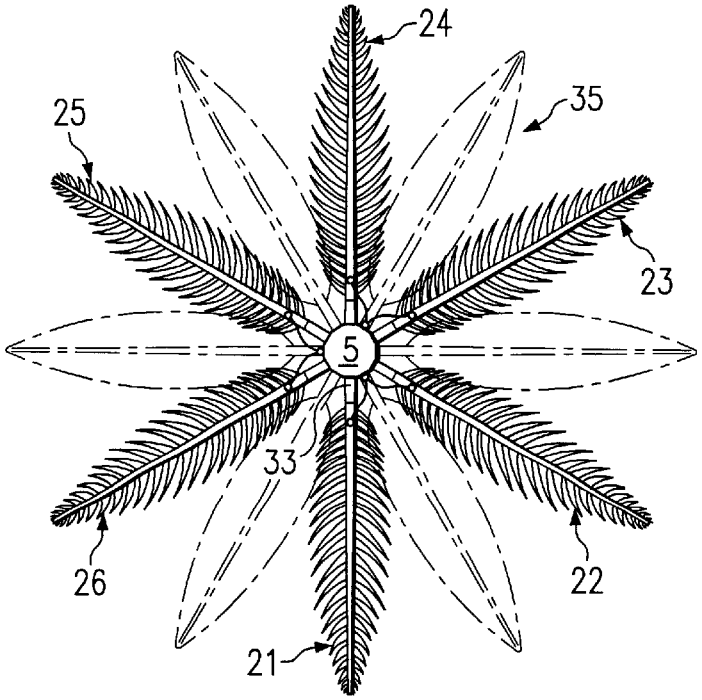
FIG. 3 is a plan view of the second highest corona of the welded female receptors with artificial fronds.

FIG. 3 represents another plan view immediately below corona 34 to corona 35. In this illustration corona 34 is not shown for purposes of simplicity. As with corona 34, each female receptor 33 in corona 35 is approximately eight inches in length.

Figure 4:
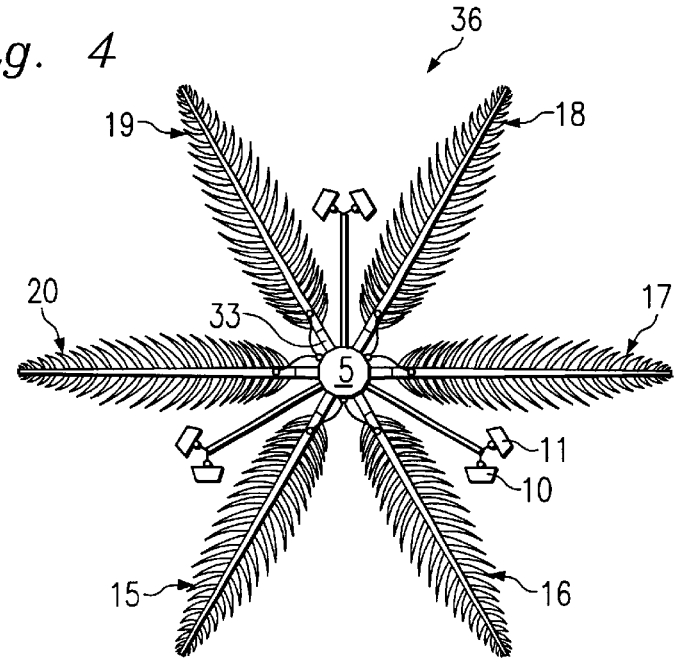
FIG. 4 is a plan view of the lowest corona of female receptors with artificial fronds.

FIG. 4 illustrates corona 36, which is lowest in height along the tower and lies immediately below corona 35. Again, each outwardly and slightly downward protruding female receptor 33 is approximately 8 inches in length and one and one-half inches in width. The angle 37 between adjacent receptors 33 projected on a horizontal plane is approximately 60 degrees in the preferred embodiment, but can range between ten degrees and 120 degrees.

In the preferred embodiment, panel antennae 10 can be seen above on extending steel supports which originate below the lowest corona 36. However, this invention also includes within its scope that the steel supports for panel antennae 10 can originate between any corona of artificial fronds 48.

Figure 5:
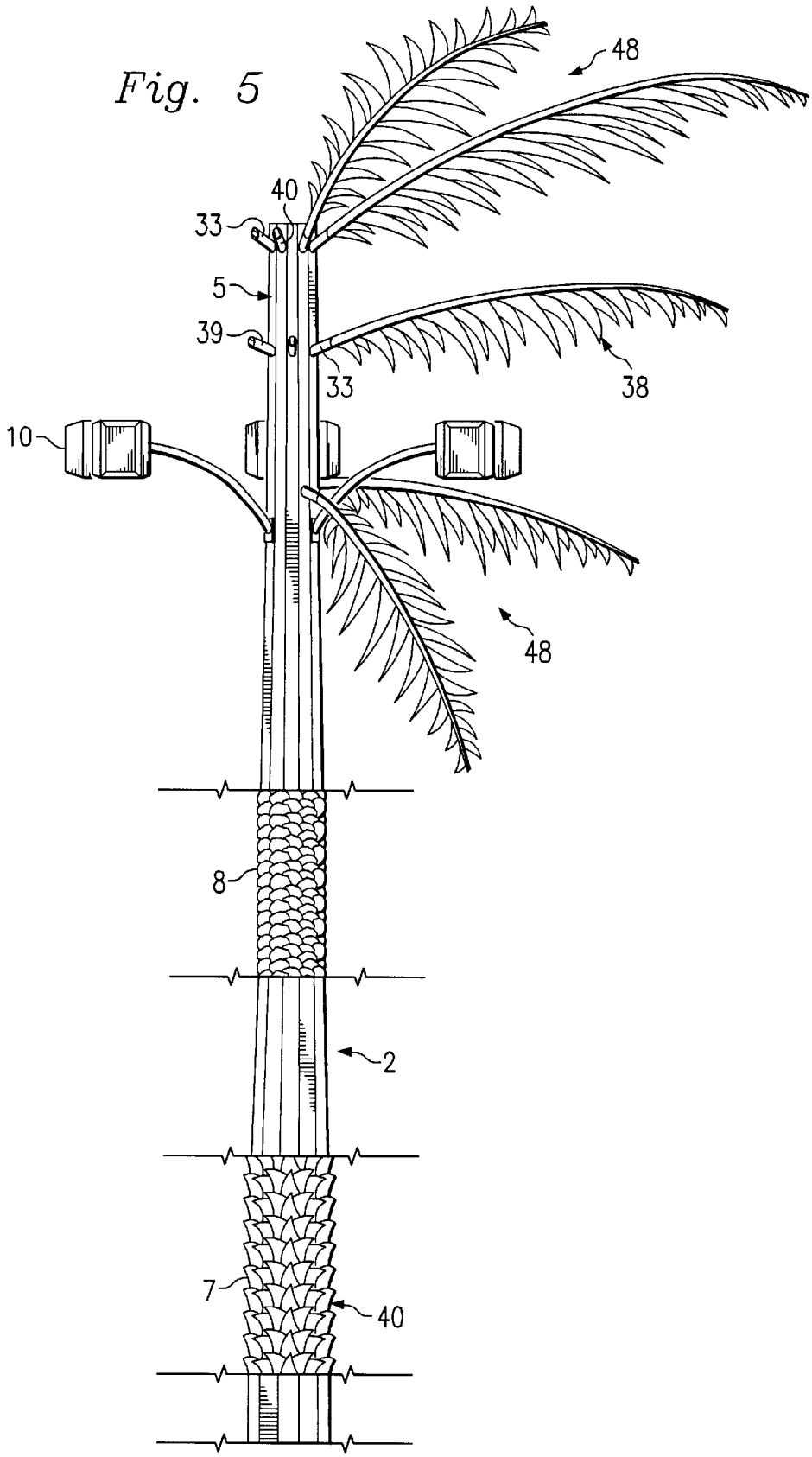
FIG. 5 illustrates a portion of the apparatus covered with the artificial palm fronds and artificial bark.

FIG. 5 illustrates how the fronds 48 appear when several are attached to one side of the monopole tower 2. In the preferred embodiment, a stem 38 of each palm frond 48 originates in female receptor 33 where it is covered, along with the aperture 39, by polyurethane. If the stem 38 is also glued in some manner, as is the bark 7,8, for the best mode the recommended mastic 40 is manufactured in St. Paul, Minn., by 3M (Industrial Specialties Division). This mastic 40 has as its principle ingredients polyol and isocyanate. However, other appropriate adhesives are also contemplated within the scope of the invention. One such alternative mastic, also manufactured by 3M, is known as construction mastic 4323. This particular mastic has synthetic rubber as a base with a hexane solvent and other additives, and is suitable for plywood, concrete, aluminum, steel, and polystyrene foam. An appropriate adhesive such as the above, but not limited thereto, is also contemplated for securing all types of artificial bark to the monopole tower 2.

Figure 6:
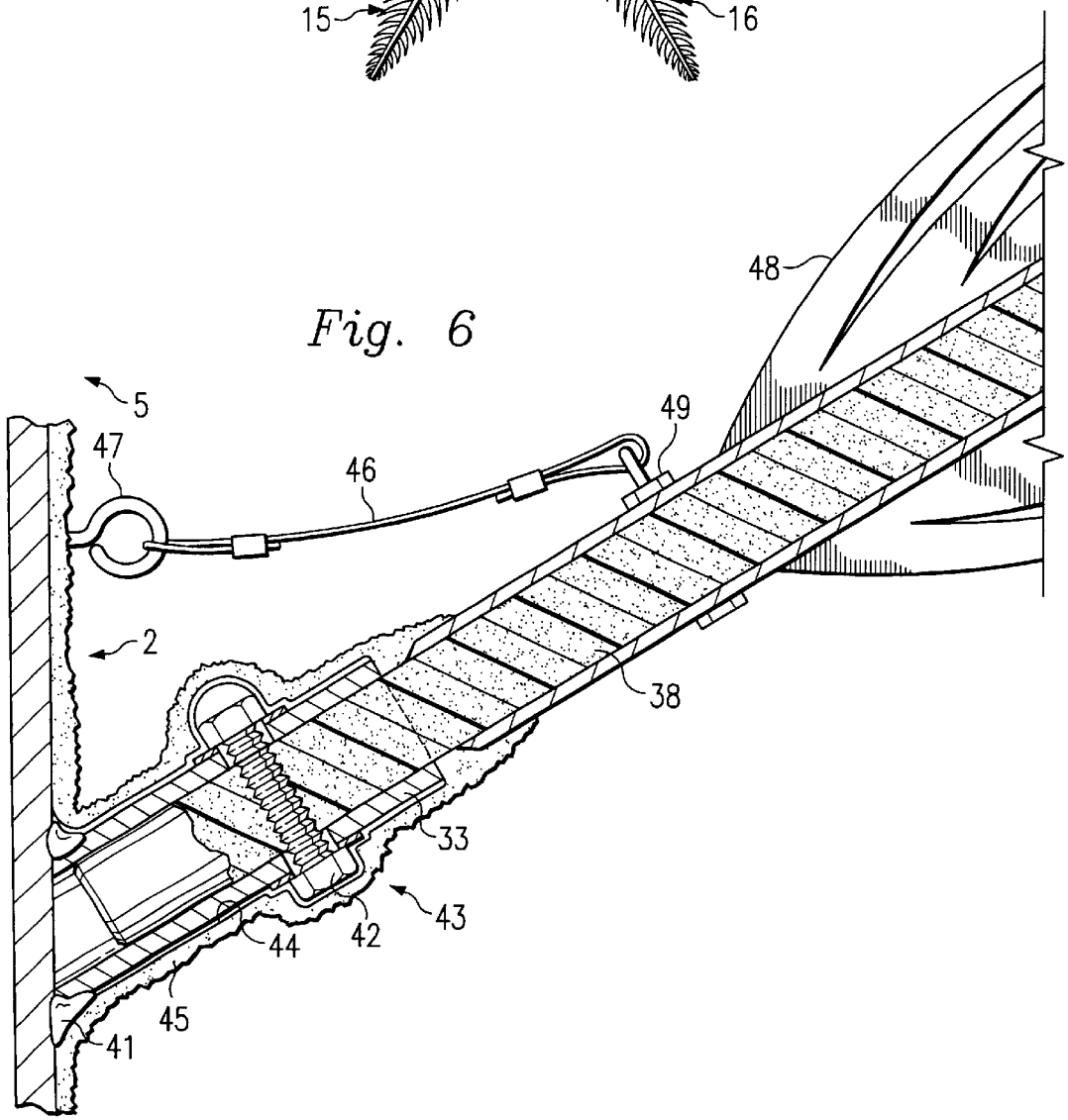
FIG. 6 is a detailed illustration of an assembly of an artificial frond securely inserted into a female receptor when welded to the monopole.

FIG. 6 illustrates in detail the preferred embodiment for attachment of each artificial frond stem 38 to each female receptor 33 for coronae 34 and 35, which have upwardly protruding receptors. Each receptor 33 is welded 41 to the side of the monopole tower 2 or to the monopole tip or cap plate 5. The metal protruding female receptor 33 is approximately eight inches long, and approximately one and one-half inches wide. There is a through bolt 42 surrounding and further securing the cylindrical female receptor 33 at approximately the receptor's midpoint 43. A polyurethane layer 44 surrounds each female receptor 33 and bolt 42, and is approximately ¼ inch thick. Superimposed over this layer 44 is bark material 45 wrapped around the female receptor 33. In the preferred embodiment the fronds 48 can also be further secured against falling by mechanical means such as a cable 46 attached to a clamp 49, which loops around the fronds and attaches to the monopole tower 2 at another location 47 on the same tower. Other mechanical means contemplated within the scope of the invention to further secure the female receptors 33 to the monopole 2 include screws and bolts.

Figure 7:
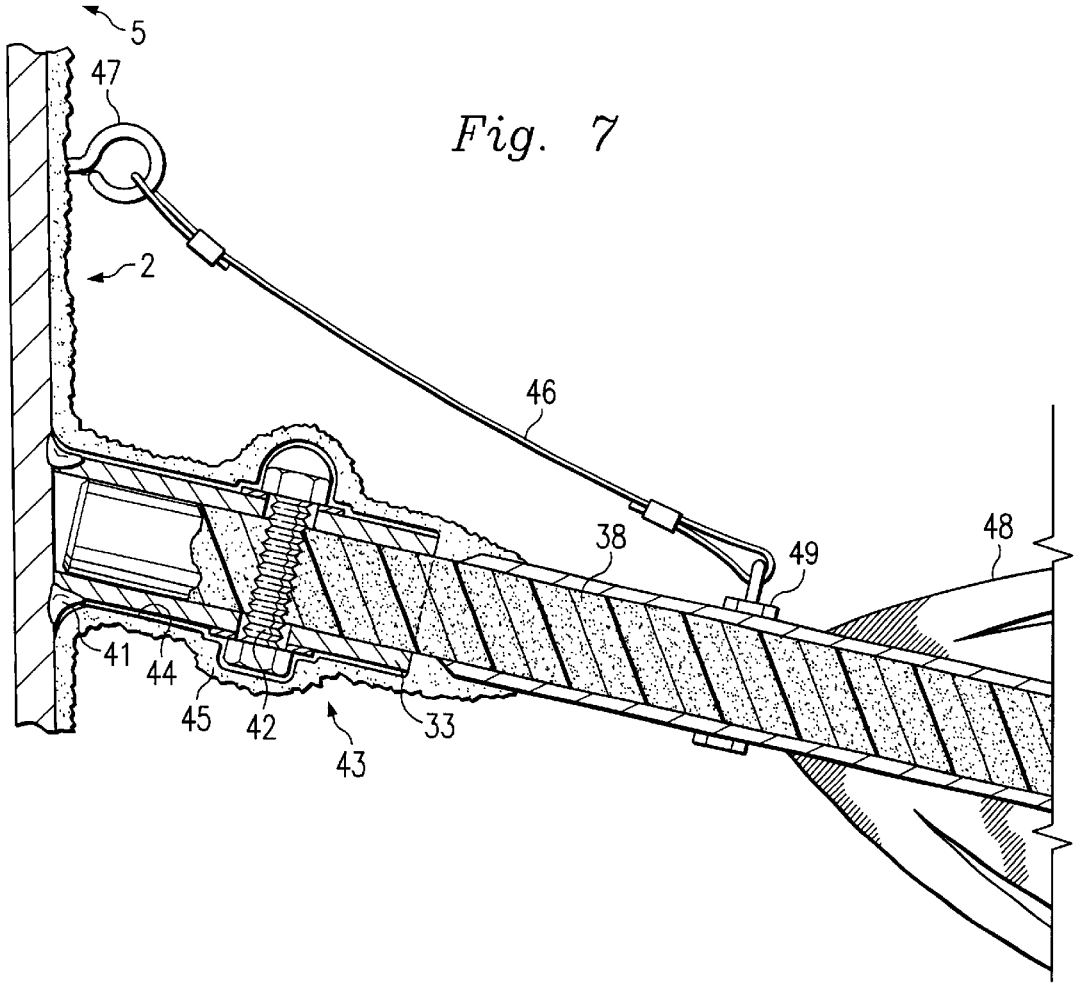
FIG. 7 is a detailed illustration of an assembly similar to that in FIG. 6, but the female receptor is now protruding slightly downward in the lowest corona on the monopole.

FIG. 7 is the same as FIG. 6, except that the fronds 48 are now emerging from the lowest corona 37. Consequently, the receptors 33 are oriented outwardly and slightly downward, instead of protruding upwards. This gives the shorter and lower fronds 48 a more natural appearance when they droop downwards and exhibit colors such as different shades of green, brown, or yellow.

The preferred embodiment of this invention is intended primarily for users of cellular telephone apparatus. However, there is no technical reason why the present invention cannot be adapted for FM broadcasting, police radio in emergency services, or taxicab radio, which use ultra-high frequencies. In the preferred embodiment the range of frequencies is from approximately 820 to 960 megahertz. However, this tower can also be used for frequencies somewhat lower or higher for the services which are mentioned above. Moreover, in this invention, all antennae panels are receiving and transmitting. Because the monopole is completely galvanized there can be no long-term penetration by corrosion. To this end each female receptor 33 is welded to the monopole 2. This weld is then covered, first with galvanized primer paint, and secondly with polyurethane simulated bark material to produce an airtight, watertight protective surface.

In particular, the metal components as described herein, together with firmly secured artificial tree components, will not interfere with these particular radio signals in the region of 820 to 960 megahertz. In addition, there is also lightening protection provided for the monopoles because of an appropriate grounding equipment. In sum, with the present invention, a purchaser will be benefitted by an aesthetically pleasing functional utility structure which will remain camouflaged in adverse weather conditions without interference with necessary radio wavelengths.

What is claimed is:

1. A telecommunications tower, comprising in combination:

a tapered steel monopole having a base and a top, the top having a diameter smaller than the base, the monopole having a polygonal side wall containing a plurality of flat facets;

at least one telecommunication antennae mounted to the monopole adjacent to the top;

a layer of artificial bark secured to and surrounding the monopole to provide the monopole with the appearance of a tree trunk;

artificial tree foliage mounted to the monopole and extending outward from the bark to disguise the tower as a tree; and a plurality of receptors secured to and protruding outward from the monopole; and wherein the artificial tree foliage comprises;

a plurality of main stem members, each of which has a base end that slidingly mates with one of the receptors;

artificial leaves carried by the main stem member;

securing means for securing each of the stem members to one of the receptors; and a plurality of safety straps, each having one end connected to the main stem member and one end connected to the monopole, to retain the main stem member and leaves with the monopole in the event of a failure of the securing means.

2. A telecommunications tower, comprising in combination:

a tapered steel monopole having a base and a top, the top having a diameter smaller than the base, the monopole having a polygonal side wall containing a plurality of flat facets;

at least one telecommunications antennae mounted to the monopole adjacent to the top;

an artificial layer of bark secured to and surrounding the monopole to provide the monopole with the appearance of a tree trunk;

a plurality of receptors, each having a base end welded to the monopole and a cylindrical outer portion protruding laterally outward from the monopole;

a plurality of main stem members, each of which has a base end that mates in a male/female connection with the outer portion of one of the receptors;

artificial leaves carried by the main stem member; and securing means for securing each of the stem members to one of the receptors; and a plurality of safety straps, each having one end connected to the the main stem member and one end connected to the monopole, to retain the main stem member and the leaves with the monopole in the event of a failure of the securing means.

3. A telecommunications tower, comprising in combination:

a tapered steel monopole having a base and a top, the top having a diameter smaller than the base, the monopole having a polygonal side wall containing a plurality of flat facets;

a casting of artificial bark having an interior which fits closely around the monopole and an exterior which simulates natural palm tree bark, the interior of the casting being adhesively secured to the monopole to provide an appearance of a palm tree trunk;

a plurality of receptors, each having a base end welded to the monopole and a tubular outer portion protruding laterally outward from the monopole;

a plurality of artificial palm frond stems, each of which has a base end that fits within the outer portion of one of the receptors, each of the stems having artificial palm frond leaves mounted thereto to disguise the tower as a palm tree;

a fastener extending transversely through each of the outer portions of each of the receptors and the base end of each of the stems for securing each of the stems to one of the receptors;

at least one telecommunications antennae mounted to an upper portion of the monopole; and a plurality of safety straps, each having one end connected to the stem and one end connected to the monopole, to retain the main stem and the leaves with the monopole in the event of a dislocation of the stem from the receptor.

* * * * *